US006675861B2

(12) United States Patent
Palmer et al.

(10) Patent No.: US 6,675,861 B2
(45) Date of Patent: Jan. 13, 2004

(54) BRAKE FOR A CORDLESS BLIND

(75) Inventors: Roger C. Palmer, Greensboro, NC (US); Zazu Ciuca, Greensboro, NC (US)

(73) Assignee: Newell Window Furnishings, Inc., Freeport, IL (US)

( * ) Notice: Subject to any disclaimer, the term of this patent is extended or adjusted under 35 U.S.C. 154(b) by 0 days.

(21) Appl. No.: 10/016,981

(22) Filed: Dec. 14, 2001

(65) Prior Publication Data

US 2003/0111189 A1 Jun. 19, 2003

(51) Int. Cl.[7] ..... E06B 9/30
(52) U.S. Cl. ..... 160/170; 188/82.1; 242/385.4
(58) Field of Search ..... 160/170 R, 171 R, 160/191, 192; 242/373, 375.1, 377, 378.1, 397.5, 381.4, 382.6, 388.2, 388.3, 388.5, 385.4; 188/82.1, 82.7

(56) References Cited

U.S. PATENT DOCUMENTS

| | | | | |
|---|---|---|---|---|
| 927,090 | A | | 7/1909 | Anderson |
| 948,239 | A | | 2/1910 | MoManus |
| 1,215,985 | A | | 2/1917 | Plate |
| 1,669,255 | A | | 5/1928 | Landry |
| 1,721,501 | A | | 7/1929 | McKee |
| 1,804,811 | A | | 5/1931 | Rosel |
| 1,971,498 | A | * | 8/1934 | Norling |
| 2,049,518 | A | | 8/1936 | Schier |
| 2,053,356 | A | | 9/1936 | Wiener |
| 2,129,606 | A | | 9/1938 | Nisenson |
| 2,132,991 | A | | 10/1938 | Mintz |
| 2,172,657 | A | | 9/1939 | Haase |
| 2,175,977 | A | | 10/1939 | Stuber et al. |
| 2,276,716 | A | | 3/1942 | Cardona |
| 2,390,826 | A | | 12/1945 | Cohn |
| 2,420,301 | A | | 5/1947 | Cusumano |
| 2,609,193 | A | | 9/1952 | Foster |
| 2,698,146 | A | * | 12/1954 | Becker |
| 2,732,010 | A | | 1/1956 | Griesser |
| 2,824,608 | A | | 2/1958 | Etten |
| 3,100,013 | A | | 8/1963 | Randmark |
| 3,339,030 | A | * | 8/1967 | Nilsson |
| 3,727,665 | A | | 4/1973 | Debs |
| 3,744,544 | A | | 7/1973 | Wellensiek |

(List continued on next page.)

FOREIGN PATENT DOCUMENTS

| | | |
|---|---|---|
| CN | 2066068 U | 11/1990 |
| DE | 40 03 218 | 8/1956 |
| EP | 1 039 092 | 9/2000 |
| EP | 1 223 296 | 7/2002 |
| FR | 883 709 | 7/1943 |
| FR | 2 337 809 | 7/1977 |

OTHER PUBLICATIONS

International Search Report, International Application No. PCT/US02/37168, mailed Feb. 24, 2003.

F.A Votta, The Theory and Design of Long–Deflection Constant–Force Spring Elements, Transactions of the Asme, May 1952, pp. 439–450.

*Primary Examiner*—Blair M. Johnson
(74) *Attorney, Agent, or Firm*—Marshall, Gerstein & Borun LLP

(57) ABSTRACT

A window covering including a head rail, a bottom rail, a window covering material extending between the head rail and bottom rail, a first and second lift cords extending between the head rail and the bottom rail, a spring motor configured to bias the bottom rail toward the head rail, mounted in the bottom rail, and operatively coupled to the first and second lift cords, and a brake mounted in the bottom rail and configured to releasably couple to the first lift cord to prohibit the spring motor from taking up the first cord, prohibiting the bottom rail from being raised or lowered.

25 Claims, 12 Drawing Sheets

U.S. PATENT DOCUMENTS 3,799,236 A 3/1974 Debs
3,918,513 A 11/1975 Englund et al.
3,931,846 A 1/1976 Zilver
3,952,789 A 4/1976 Marotto
4,039,020 A 8/1977 Jacobson
4,180,118 A 12/1979 Vecchiarelli
4,245,688 A 1/1981 Vecchiarelli
4,250,597 A 2/1981 Ford et al.
4,352,386 A 10/1982 Butler et al.
4,398,585 A 8/1983 Marlow
4,476,909 A 10/1984 Anderle et al.
4,487,243 A 12/1984 Debs
4,488,588 A 12/1984 McClure
4,574,864 A 3/1986 Tse
4,610,292 A 9/1986 Hausmann et al.
4,649,982 A 3/1987 Baumann et al.
4,674,550 A 6/1987 Graves
4,722,383 A 2/1988 Kross
4,862,941 A 9/1989 Colson
4,884,618 A 12/1989 Steeves
4,945,970 A 8/1990 Marocco
4,982,776 A 1/1991 Kuhar et al.
5,054,162 A 10/1991 Rogers
5,067,541 A 11/1991 Coslett
5,103,888 A 4/1992 Nakamura
5,105,867 A 4/1992 Coslett
5,143,135 A 9/1992 Kuhar
5,156,196 A 10/1992 Corey et al.
5,170,830 A 12/1992 Coslett
5,400,521 A * 3/1995 Waldherr
5,472,036 A 12/1995 Judkins
5,482,105 A 1/1996 Rude
5,538,066 A 7/1996 Liu
5,547,009 A 8/1996 Plumer
5,623,982 A 4/1997 Okazaki
5,671,793 A 9/1997 Lee
5,699,847 A 12/1997 Villette et al.
5,795,008 A * 8/1998 Allen
5,799,715 A 9/1998 Biro et al.
5,853,040 A 12/1998 Benthin
6,024,154 A * 2/2000 Wang et al.
6,029,734 A * 2/2000 Wang et al.
6,032,716 A 3/2000 Mattey
6,047,759 A 4/2000 Lysyj
6,047,760 A 4/2000 Judkins
6,050,321 A 4/2000 Koks et al.
6,056,036 A 5/2000 Todd et al.
6,112,800 A 9/2000 Marusak
6,129,131 A 10/2000 Colson
6,142,211 A 11/2000 Judkins
6,155,328 A 12/2000 Welfonder
6,158,563 A 12/2000 Welfonder et al.
6,213,421 B1 * 4/2001 Franklin
6,223,802 B1 5/2001 Colson
6,283,192 B1 9/2001 Toti
2002/0157796 A1 10/2002 Judkins ..... 160/84.04

* cited by examiner

BRAKE FOR A CORDLESS BLIND

FIELD OF THE INVENTION

The present invention relates to a system in which outer lifting cords are eliminated from shades or blinds. More specifically, the present invention relates to window covering systems that employ one or more springs to accumulate the lifting cord within the head rail and/or bottom rail as the blind or shade is raised or lowered and a brake to secure the bottom rail in a static position.

BACKGROUND OF THE INVENTION

It is generally known to provide for a window covering venetian blind with the slats that are raised and lowered by a pair of lift cords. Such known window coverings typically include lift cords that are secured to a bottom rail and extend upward through the slats into a head rail. The lift cords are guided within the head rail and exit through a cord lock and hang outside of the window covering. In order to raise or lower the window covering, the lift cords are manipulated to first release the cord lock. Similarly, once the window covering has been raised or lowered the cord lock is manipulated again to lock the cords in place. However, such an arrangement may present a safety concern to small children and pets.

Blinds and shades in which the lift cords are contained within the bottom rail, window covering and head rail are referred to as "cordless" blinds and shades because no portion of the lift cords is external to the blind or shade. Cordless blinds have been gaining popularity and are employed in a wide variety of blinds and shades such as venetian blinds, cellular blinds, pleated shades, and wood blinds.

One way to provide a "cordless" blind is to "balance" the window blind system. In a "balanced" cordless blind, the spring force of the spring motor is balanced by the combined weight of the bottom rail (and any accumulated window covering) and friction, sometimes misidentified in the field as inertia. In such balanced systems the friction is greater than the difference between the spring force and the combined weight of the bottom rail and accumulated window covering when the bottom rail is at any location between a fully extended position and a fully retracted position. However, such known cordless blinds have several disadvantages for a mass-merchandise avenue of distribution, including friction systems that are costly to assemble and manufacture, and difficult to incorporate in to size-in-store adjustment.

Another way to provide a "cordless" blind is to include a brake that is configured to clamp onto one or more of the lift cords or engages the spring motor. One such known blind is shown in U.S. Pat. No. 6,029,734, and shows a venetian blind having a spring retrieving unit and spindle in a head rail, and a cord brake mechanism in a bottom rail. However, because the cord brake mechanism is located in the bottom rail while the spring motor is in the head rail and the lift cords connect the bottom rail to the head rail, it is only useful to prevent the bottom rail from free falling. As such, the spring retrieving unit must be weak so that the bottom rail does not creep upward. Also, opening of blind requires the user to exert effort to lift bottom rail and patience to wait for the weak spring retrieving units to wind up the slack cords.

Accordingly, it would be advantageous to provide a window covering with a strong spring motor that is configured to bias the bottom rail upward and capable of raising bottom rail absent a brake. It would also be advantageous to provide a cordless window covering with a cord brake that prevents the bottom rail from moving up or down.

A brake system that overcomes the disadvantages of the more complex and cumbersome systems of the prior art would represent a significant advance in this art.

SUMMARY OF THE INVENTION

How these and other advantages and features of the present invention accomplished (individually, collectively, or in various subcombinations) will be described in the following detailed description of the preferred and other exemplary embodiments, taken in conjunction with the FIGURES. Generally, however, they are accomplished in a window covering including a head rail, a bottom rail, a window covering material extending between the head rail and bottom rail, first and second lift cords extending between the head rail and the bottom rail, a biasing element such as a spring motor, and a brake. The spring motor is configured to bias the bottom rail toward the head rail, is mounted in the bottom rail, and is operatively coupled to the first and second lift cords. The brake is mounted in the bottom rail and configured to releasably couple to the first lift cord to prohibit the spring motor from taking up the first cord, which prohibits the bottom rail from being raised or lowered. The brake can include a one-way tensioning mechanism and a user interface. The one-way tensioning mechanism is configured to provide a resistant force on movement of the first lift cord. The user interface is configured to move the one-way tensioning mechanism between a stopped condition and a free-wheeling condition.

These and other advantages and features of the present invention may also be accomplished in a window covering mounted in a window frame. The blind includes a head rail, a bottom rail, a window covering material extending between the head rail and bottom rail, at least one lift cord extending between the head rail and the bottom rail, a first spring motor operatively coupled to the at least one lift cord and configured to bias the bottom rail toward the head rail, a first guide cord having a first end coupled to the window frame and at least partially located in the bottom rail, and a brake mounted in the bottom rail. The brake is configured to releasably couple to the first guide cord to prohibit the first guide cord from sliding through the brake, prohibiting the bottom rail from being raised or lowered.

These and other advantages and features of the present invention may also be accomplished in a window covering including a head rail mounted to a bracket, a bottom rail, a window covering material extending between the head rail and bottom rail, at least one lift cord extending between the head rail and the bottom rail, a spring motor mounted to the bracket, operatively coupled to the at least one lift cord, and configured to bias the bottom rail toward the head rail, and a brake directly coupled to the spring motor and configured to selectively prohibit the bottom rail from being raised and lowered.

These and other advantages and features of the present invention may also be accomplished in a window covering including a head rail, a bottom rail, a window covering material extending between the head rail and bottom rail, a pair of lift cords extending between the head rail and bottom rail, a spring motor, a brake, and a remote user interface. The spring motor is mounted in the head rail and is configured to bias the bottom rail toward the head rail. The brake is configured to selectively prohibit winding or unwinding of the lift cords from the spring motor. The remote user interface is coupled to the brake for selectively operating the brake without having to reach the head rail.

These and other advantages and features of the present invention may also be accomplished in a window covering comprising a head rail, a bottom rail, a window covering material extending between the head rail and bottom rail, first and second lift cords extending between the head rail and the bottom rail, a biasing element configured to bias the bottom rail toward the head rail, and operatively coupled to the first and second lift cords, and a brake assembly configured to inhibit movement of the bottom rail. The brake assembly includes a brake releasably coupled to the biasing element, a brake lever pivotally coupled to the bottom rail, and a user interface operatively coupled to the brake lever and configured to pivot it to a first position wherein the brake is in an engaged position and a second position wherein the brake is in a disengaged position.

The present invention further relates to various features and combinations of features shown and described in the disclosed embodiments. Other ways in which the objects and features of the disclosed embodiments are accomplished will be described in the following specification or will become apparent to those skilled in the art after they have read this specification. Such other ways are deemed to fall within the scope of the disclosed embodiments if they fall within the scope of the claims which follow.

DETAILED DESCRIPTION OF PREFERRED AND OTHER EXEMPLARY EMBODIMENTS

The embodiments illustrated in FIGS. 1–10 apply a braking mechanism to ensure that the bottom rail does not move (e.g. from accumulator weight of bottom rail and slats or from the spring force).

To ensure that the bottom rail does not move downward without additional force (commonly referred to as "creep"), the combined weight of the bottom rail (BRw) and the accumulated window covering (WCw) must be less than the forces resisting downward movement including the system friction (Ffd) resisting downward movement and the spring force of the spring motor (SMf). This can be expressed as (BRw+WCw)<(SMf+Ffd). The system friction (Ff) tends to oppose movement in both directions, although not necessarily with the same force, depending on the source of the system friction. Accordingly, system friction that opposes downward movement of the bottom rail will be designated Ffd and system friction that opposes upward movement of the bottom rail will be designated Ffu.

To ensure that the bottom rail does not move upward (e.g., due to the spring force), the brake is engaged to secure the bottom rail in the set position. For the bottom rail to be urged upward when the brake is released the spring force must be greater than the forces resisting upward movement of the bottom rail: SMf>Ffu+(BRw+WCw).

The brake applies a braking force (Bf) to a first cord and/or a second cord. The particular braking force applied to the cords is intended to be greater than the spring force of the spring motor (SMf) minus the combined weight of the bottom rail (BRw) and the weight of accumulated window covering (WCw) and the system friction (Ffu) opposing upward motion of the bottom rail. This can be expressed as Bf>SMf−(BRw+WCw+Ffu).

This relationship ensures that the braking force (Bf) applied by the brake will be sufficient to prohibit the bottom rail from moving downward and away from the head rail without additional force, and sufficient to prohibit the lift cords from rewinding thereby causing the bottom rail to move upward without releasing the brake. The braking force (Bf) introduced by the brake is configured to be sufficient to prevent the blind from moving downward: Bf>(BRw+WCw)−(SMf+Ffd).

Figure 1:
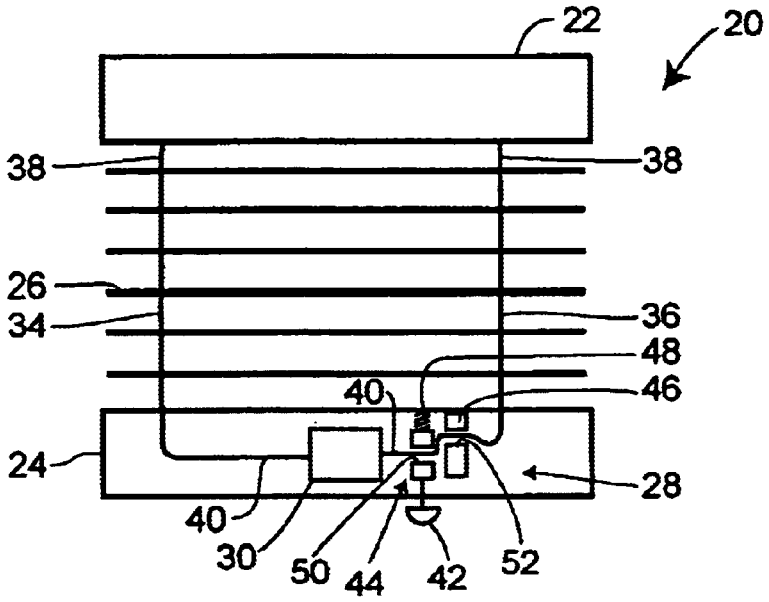
FIG. 1 is a schematic view of a cordless blind with a brake according to an exemplary embodiment.

FIG. 1 is a schematic view of a blind 20 according to an exemplary embodiment. Blind 20 includes a head rail 22, a bottom rail 24, a plurality of slats 26 located therebetween, and a brake 28 configured to secure bottom rail in a set position. Bottom rail 24 includes a spool and spring motor assembly 30 and brake 28. Alternatively, spooled spring motor assembly 30 is mounted in head rail 22. Spool and spring motor assembly 30 includes a spring motor coupled to one or more spools which wind and store cords 34, 36. Cords 34, 36 are configured to suspend bottom rail 24 from head rail 22, each includes a first end 38 connected to head rail 22 and a second end 40 wound about the spools.

Brake 28 is mounted in bottom rail 24 and includes a user interface (shown as a button 42), a first brake member 44, a second brake member 46, and a biasing member (shown as a spring 48) coupled to first brake member 44. Cord 36 passes through apertures 50, 52 in first and second brake members 44, 46, and is configured to be secured or locked when aperture 50 is not aligned with aperture 52 (i.e., "engaged"). First brake member 44 is movably (e.g., slidably or pivotally) mounted to bottom rail 24, and is biased in the engaged position by spring 48 (aperture 50 is misaligned with aperture 52 so that cord 36 is gripped or pinched between first and second brake members 44, 46). According to a preferred embodiment, brake 28 engages (clamps) cord 36 to prevent it from winding upon a spool in spring motor assembly 30 thereby preventing spring motor assembly 30 from operating (and winding or unwinding cord 34). Preferably, the two spools for the two cords 66 are operatively coupled so that a single brake 28 is used to brake one of the two cords. Examples of such an arrangement is disclosed in U.S. Pat. No. 5,482,100 (titled "Cordless, Balanced Venetian Blind Or Shade With Consistent Variable Force Spring Motor," issued Jan. 9, 1996), which is incorporated by reference herein. By braking one cord, the coupled spool is inhibited from moving. Alternatively, a pair of brakes 28 can be used to brake both cords 66.

Figure 2:
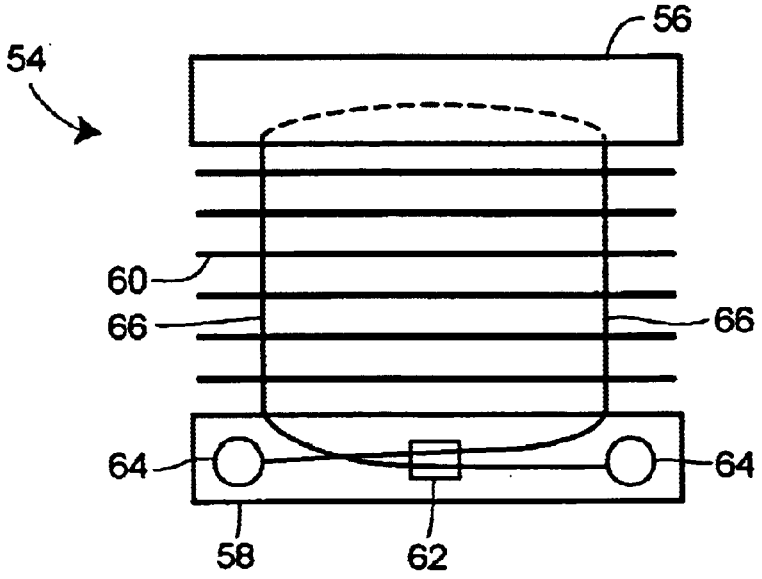
FIG. 2 is a schematic view of a cordless blind with a brake according to an exemplary embodiment.

FIG. 2 is a schematic view of a blind 54 according to a further exemplary embodiment. Blind 54 includes a head rail 56, a bottom rail 58, a plurality of slats 60 located therebetween, and a brake 62. Bottom rail 58 includes a pair of spaced apart spool and spring motor assemblies 64, each assembly having a spring motor coupled to a spool.

A pair of cords 66 are configured to suspend bottom rail 58 from head rail 56. Each cord 66 includes a first end connected to head rail 56 and a second end wound about one of the spools. (As shown in broken lines, lift cords 66 may be a single continuous cord that passes through head rail 22.)

Brake 62 is mounted in bottom rail 58 and located between spaced apart spool and spring motor assemblies 64. Brake 62 is biased to secure or lock both cords 66 when a user interface is not being operated by a user.

Figure 3:
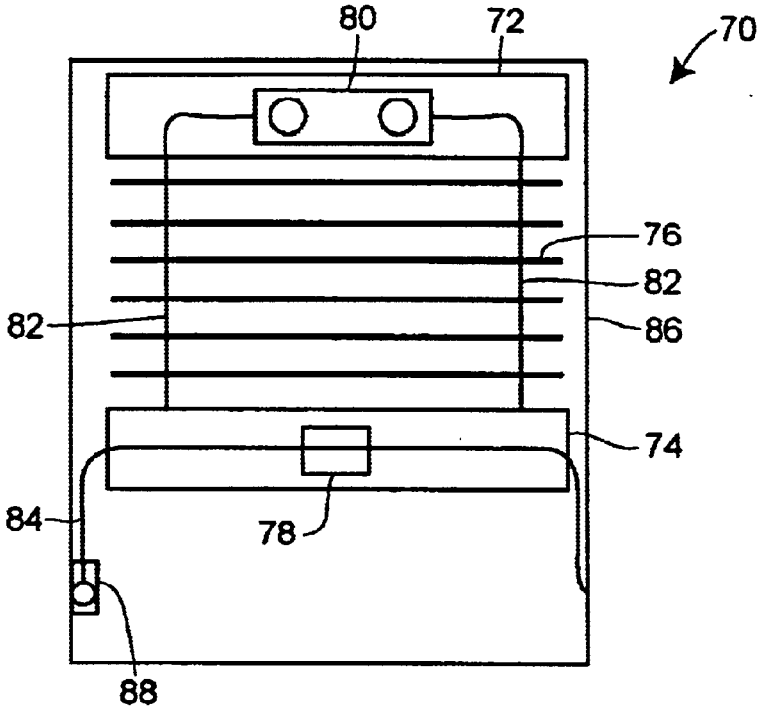
FIG. 3 is a schematic view of a cordless blind with a brake according to an exemplary embodiment.

FIG. 3 is a schematic view of a blind 70 according to another exemplary embodiment. Blind 70 includes a head rail 72, a bottom rail 74, a plurality of slats 76 located therebetween and a brake 78 configured to secure bottom rail in a set position. Head rail 72 includes a spool and spring motor assembly 80. A pair of cords 82 are connected at one end to bottom rail 74 and wound about spools in spool and spring motor assembly 80. A secondary or guide cord 84 is anchored or connected at one end adjacent to blind 70 (e.g., the window sill or frame 86 or similar structure). The other end of secondary cord 84 is coupled to a second spool and spring motor assembly 88, which is fixedly attached adjacent blind 70 (e.g., to window sill 86). Thus, first spool and spring motor assembly 80 is coupled to bottom rail 74 by cords 82 and is configured to bias bottom rail 74 in an upward direction towards head rail 72. When brake 78 is engaged with secondary cord 84 bottom rail 74 is held in a static position. When brake 78 is released, secondary cord 84 is allowed to pass through bottom rail 74 and brake 78, thereby allowing bottom rail 74 to move upwardly or downwardly depending on the operators manual movement of bottom rail.

Figure 4:
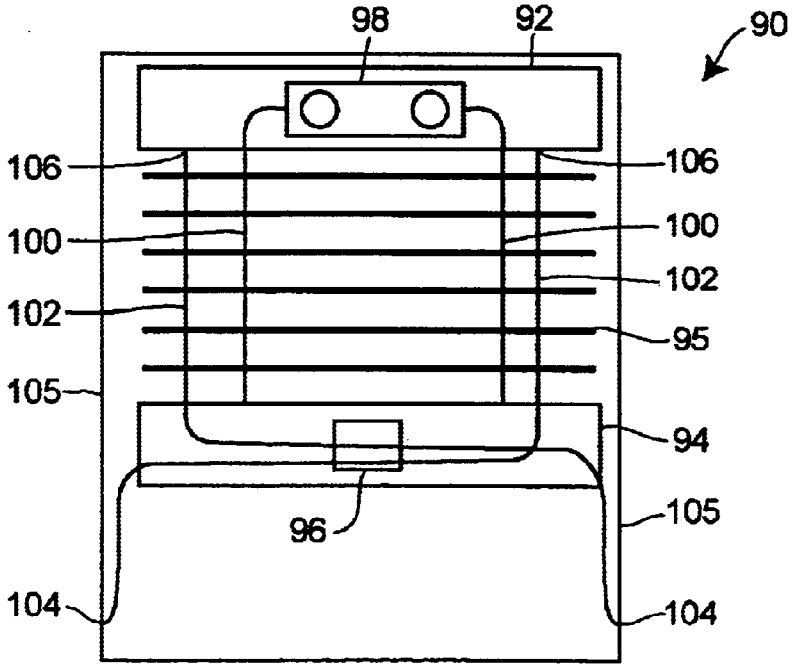
FIG. 4 is a schematic view of a cordless blind with a brake according to an exemplary embodiment.

FIG. 4 is a schematic view of a blind 90 according to a further exemplary embodiment. Blind 90 includes a head rail 92, a bottom rail 94, a plurality of slats 95 located therebetween and a brake 96 configured to secure bottom rail in a set position. A spool and spring motor assembly 98 is mounted in head rail 92 and is coupled to bottom rail 94 by a pair of cords 100. Spool and spring motor assembly 98 is configured to bias bottom rail 94 in an upward direction such that if no countervailing force was provided, bottom rail 94 would move upward toward head rail 92. (Alternatively, the spring force may be weak so that bottom rail 94 moves downward). Brake 96 is mounted in bottom rail 94 and is configured to releasably engage a pair of secondary or guide cords 102. Secondary cords 102 are connected at a first end 104 to a fixed surface adjacent blind 90 (e.g., a window sill or frame 105) and pass through bottom rail 94 and brake 96. Secondary cord 102 exits from bottom rail 94 opposite from where they enter and are connected at a second end 106. When brake 96 is released and secondary cords 102 are disengaged, bottom rail 94 may be moved upward and downward, whereby secondary cords 102 slide freely to allow bottom rail to be adjusted.

Figure 5:
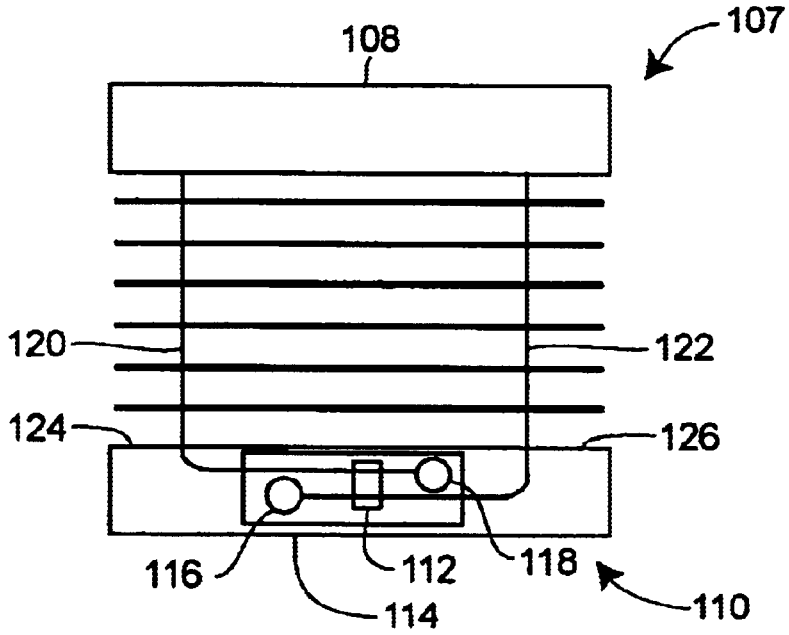
FIG. 5 is a schematic view of cordless blind with a brake according to an exemplary embodiment.

FIG. 5 is a schematic view of a blind 107 according to another exemplary embodiment. Blind 107 includes a head rail 108 a bottom rail 110, a plurality of slats located therebetween and a brake 112 configured to secure bottom rail in a set position. Bottom rail 110 includes a spool and spring motor assembly 114 having a spring motor coupled to a pair of spools 116, 118. A first and second cord 120, 122 are configured to suspend bottom rail 110 from head rail 108, each having a first end connected to head rail 108 and a second end wound about spool 116 or spool 118.

First cord enters bottom rail 110 at a first end 124 and passes through brake 112 before being wound about spool 118. Second cord 122 enters bottom rail at a second end 126 opposite first end 124 and also passes through brake 112 before being wound about spool 116. Brake 112 releasably engage cords 112, 114 such that when brake 112 is disengaged, cords 120, 122 are free to slide through brake 112 and wind about or unwind from spools 116, 118. When brake 112 is engaged, cords 120, 122 are inhibited from winding about or unwinding from spools 116, 118.

Figure 6:
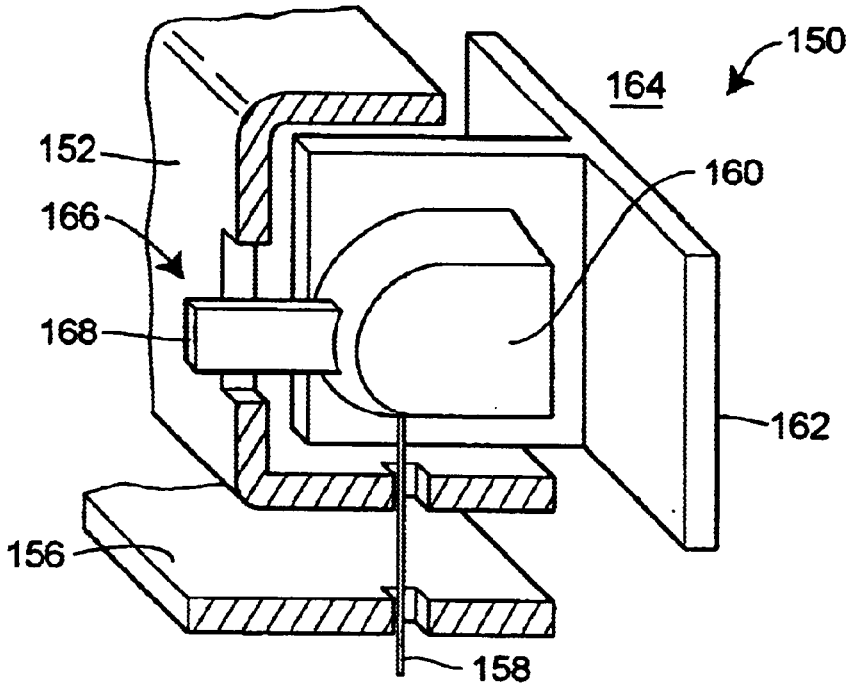
FIG. 6 is a schematic view of cordless blind with a brake according to an exemplary embodiment.

FIG. 6 is a schematic view of a blind 150 according to an exemplary embodiment. Blind 150 includes a head rail 152, a bottom rail (not shown), and a plurality of slats 156 located therebetween. A pair of cords 158 are coupled at one end to bottom rail 154 and at the other end around about a pair of spools coupled to a pair of spring motors 160 located in head rail 152.

Spring motor assemblies 160 include a spool operably coupled to a spring motor, and are mounted to brackets 162 that are configured to mount head rail 152 to an adjacent wall 164. Mounting spring motors assemblies 160 to brackets 162 is configured to provide additional stability and a more secure mounting, particularly when spring motors have a strong spring (e.g., to bias blinds in an open or up position, for larger sized blinds, and the like). Mounting spring motors 160 to brackets 162 also is intended to allow the walls of head rail 152 (or the bottom rail) to have a thinner wall thickness, less reinforcement, or more ornate or stylish construction.

A brake 166 is configured to selectively apply a braking force to the spring motor or cords 158. According to a preferred embodiment, spring motor assemblies with brake 166 are similar in design and operability to conventional tape measures, and include a housing with a spool biased to retract cord 158 into a housing as the bottom rail is lowered.

A locking member 168 is provided for selectively applying a substantially normal pressure to cord 158 (e.g., transverse to the movement path to positively lock cord 158 against the housing and prevent cord 158 from moving relative to the housing). Preferably, locking member 168 is a rocking button that can be used to actuate brake 166 to decrease braking forces in the releasing position (e.g., maintaining the locking member disengaged from cord 158, urging the locking member into contact with cord 158 and actuating to increase the braking forces in the locking position). Brake 166 can also be configured to apply intermediate braking forces on cord 158 while maintaining the locking member disengaged from cord 158 in the neutral position of the rocking button. Also, by associating brake 166 with head rail 152, brake 166 is out or reach of children and pets, and is intended to reduce the possibility of inadvertent release of brake 166.

Figure 7:
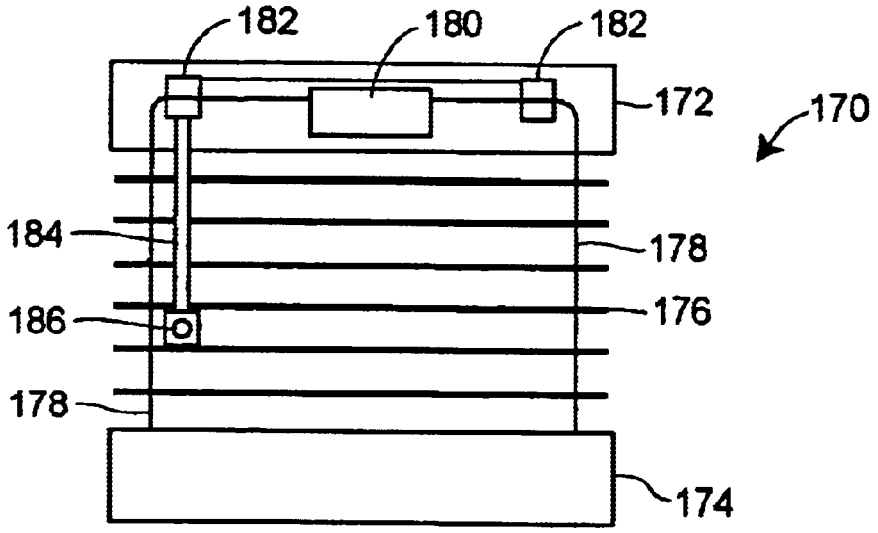
FIG. 7 is a schematic view of a cordless blind with a brake according to an exemplary embodiment.

FIG. 7 is a schematic view of a blind 170 according to an exemplary embodiment. Blind 170 includes a head rail 172, a bottom rail 174, and a plurality of slats 176 located therebetween. A pair of cords 178 are coupled at one end to bottom rail 174 and at the other end around about a pair of spools located in head rail 172. The spools coupled to a spring motor 180. A brake 182 coupled to cords 178 or spring motor 180 is mounted in head rail 172. A remote user interface (shown as a rod or wand 184) is coupled to brake 182 and is configured to selectively engage brake 182 to allow raising or lowering of bottom rail 174. According to a preferred embodiment, bottom rail 174 is biased to move upward (open) when no braking force is being applied.

To adjust blind 170, wand 184 is manipulated (lifted, twisted, rotated, etc.) to release brake 182, which causes the bottom rail 174 to raise due to the upward biasing force (which is larger than the weight of the bottom rail 174 and accumulated slats 176). Wand 184 can again be manipulated to re-engage brake 182. (Alternatively, the biasing force is weaker than the weight of bottom rail 174 and accumulated slats 176 so that bottom rail 174 tends to move downward until brake 182 is re-engaged.) According to an exemplary embodiment, wand 184 includes a button 186 to operate brake 182 (e.g., engage or disengage) rather than particular movements of wand 184.

Figure 9:
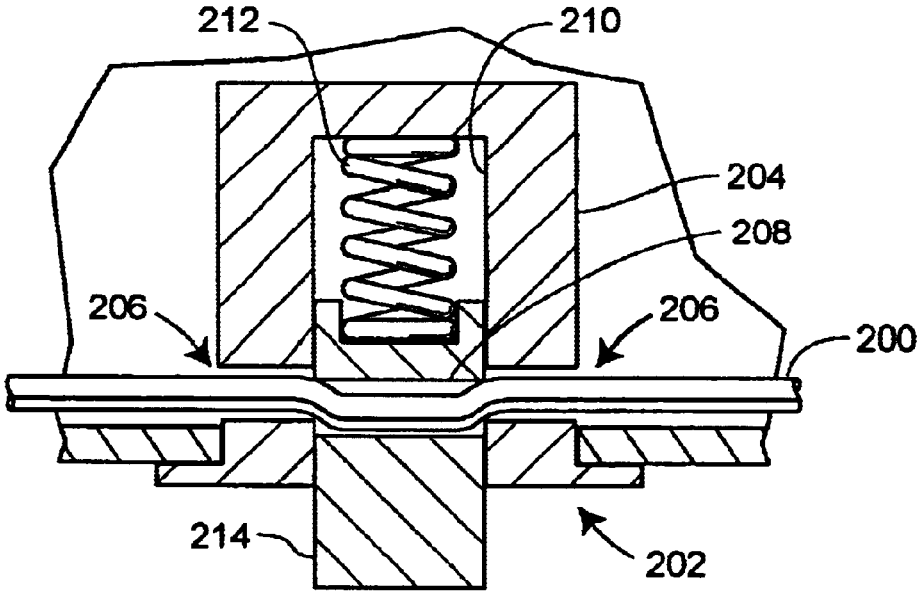
FIG. 9 is a horizontal sectional view of a cord brake according to an exemplary embodiment.
Figure 10:
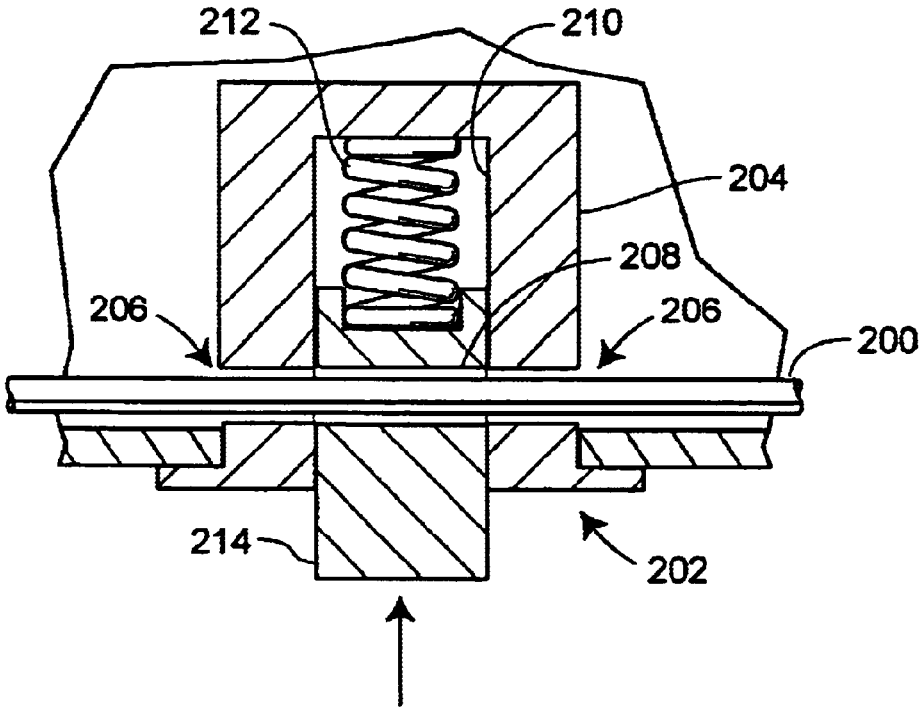
FIG. 10 is a similar view as FIG. 9 but with the brake being shown in the disengaged position.

According to an exemplary embodiment, the brake is configured to releasably engage one or more lift cords 200. Referring to FIGS. 9 and 10, brake 202 includes a case 204 having a pair of cord holes 206 aligned with each other on opposite sides of case 204. Case 204 also includes a bore 210 configured to receive a spring 212 and a retaining member 214. Spring 212 and retaining member 214 are situated in bore 210 such that spring 212 biases retaining member 214 out of bore 210 Lift cord 200 passes through cord holes 206 of case 204 and also through a cord hole 208 formed in retaining member 214.

Figure 8:
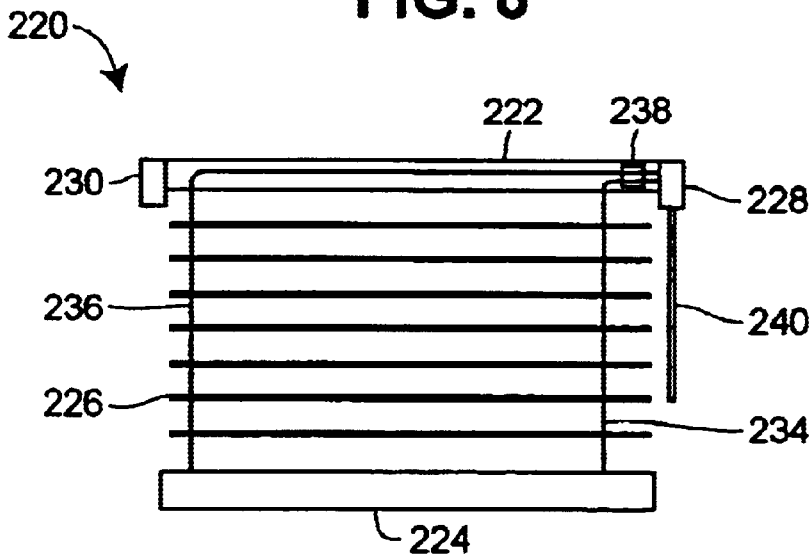
FIG. 8 is a schematic view of a cordless blind with a spring motor and brake according to an exemplary embodiment.

FIG. 8 is a schematic view of a blind 220 according to an exemplary embodiment. Blind 220 includes a head rail 222 (shown as a low profile head rail), a bottom rail 224, and a plurality of slats 226 located therebetween. A pair of end caps or head rail brackets 228, 230 are attached to brackets at both ends of head rail 222. In end cap 228, a spring motor is mounted and coupled to a pair of lift cords 234, 236 that pass through head rail 222 and slats 226 and are coupled to bottom rail 224. In a preferred embodiment, the spring motor is attached to one of the brackets at the ends of head rail 222 for stability and to allow head rail 222 to have a relatively small height profile. A brake 238 is releasably coupled to cords 234 and/or cord 236. Alternatively, brake 238 is releasably coupled to the spring motor. For easier access to brake 238, a user interface, such as a wand 240, may be provided.

As shown in FIG. 9, when retaining member 214 is naturally urged by spring 212, cord hole 208 of retaining member 214 and cord holes 206 of case 204 are located alternately to bring about the clamping effect that acts on lift cord 200. By the clamping force or locking engagement of brake 202, the rewinding force of spring motor and storage is overcome. As a result, the bottom rail can be located at any desired position without inadvertent rewinding.

Referring to FIG. 10, when retaining member 214 is pushed deeper into bore 210 by an external force, cord hole 208 of retaining member 214 moves substantially into alignment with cord holes 206 of case 204. As a result, the braking forces acting on cord 200 are substantially reduced, whereby the bottom rail can be readily moved to a new position.

Figure 11:
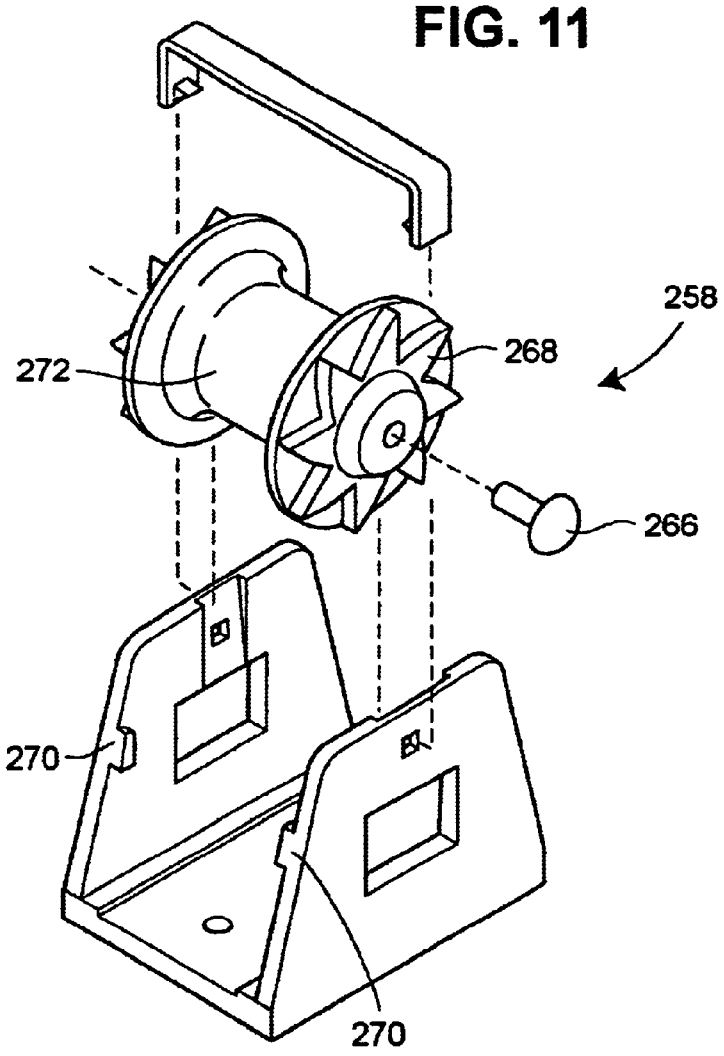
FIG. 11 is an exploded perspective view of a one-way tensioning device according to a preferred embodiment.
Figure 12:
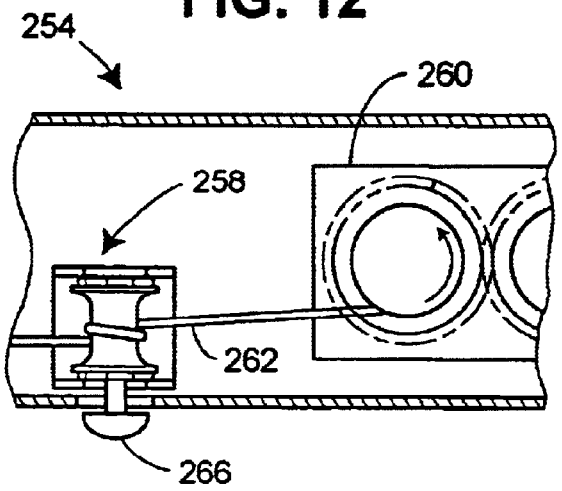
FIG. 12 is a top fragmentary sectional view of the one-way tensioning device of FIG. 11 mounted in a bottom rail.

FIGS. 11 and 12 show a brake (shown as a one-way tensioning mechanism 258) mounted in a bottom rail 254 of a blind according to an alternative embodiment. A spool and spring motor assembly 260 is mounted in bottom rail 254 and is coupled to the head rail by a pair of lift cords 262. Spool and spring motor assembly 260 is configured to bias bottom rail 254 in an upward direction such that if no countervailing force was provided, bottom rail 254 would move towards the head rail.

One-way tensioning mechanism 258 is mounted in bottom rail 254 and is configured to engage one or both lift cords 262 to provide the countervailing force to inhibit undesired upward movement of bottom rail 254. An example of a one-way tensioning mechanism is shown in U.S. patent application Ser. No. 09/918,905, filed on Jul. 21, 2001, and titled One-Way Tensioning Mechanism for Cordless Blind, which is hereby incorporated by reference.

Figure 13:
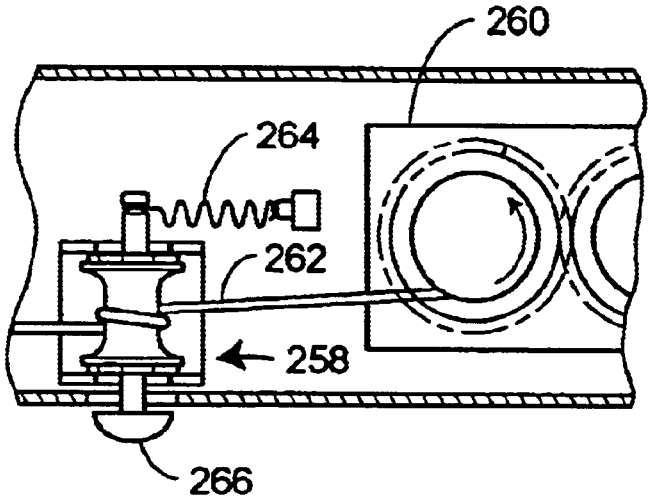
FIG. 13 is a top fragmentary sectional view of the one-way tensioning device of FIG. 11 according to an alternative embodiment.

According to an exemplary embodiment, a one-way tensioning mechanism 258 is biased toward the engaged position wherein one or both lift cords 262 are inhibited from moving by a braking or tension force when in a static position. According to a preferred embodiment, tension in lift cords 262 bias a one-way tensioning mechanism 258 toward the engaged position. According to an alternative embodiment shown in FIG. 13, a biasing member (e.g., a spring 264) biases a one-way tensioning mechanism 258 toward the engaged position.

A user interface 266 (e.g., button, switch, etc.) is operatively coupled to one-way tensioning mechanism 258 so that cords 262 can be selectively disengaged (e.g., the tension applied to cord 262 is reduced) so that cords 262 can be wound upon the spool (as bottom rail 254 is raised) or unwound (as bottom rail 254 is lowered). Operation of user interface 266 (e.g., sliding user interface 266) disengages ratchet teeth 268 from a pawl 270 to move a pulley 272 (about which cord 262 is wrapped around) between a stopped or engaged position and a free-wheeling or disengaged position. When user interface 266 is released, tension in cords 262 moves pulley from the free-wheeling position to the stopped position (where ratchet teeth 268 engage pawl 270). Because the tension or brake force prohibits bottom rail 254 from moving up (i.e., prohibits cord 262 from being taken up by spool and spring motor assembly 260), lowering of bottom rail 254 is accomplished by the user grasping bottom rail 254 and pulling downward—operation of user interface 266 to disengage one-way tensioning mechanism 258 is not required.

According to an alternative embodiment, spool spring motor assembly 260 provides a relatively weak biasing force such that bottom rail 254 tends to lower (e.g., in an undesired "free-fall"), and one-way tensioning mechanism 258 may be configured to inhibit such undesired free-fall of bottom rail 254. Alternatively, spool and spring motor assembly 260 and/or one-way tensioning a one-way tensioning mechanism 258 is mounted in the head rail. When one-way tensioning mechanism 258 is in the head rail, a remote user interface (e.g., a wand or similar device) may be provided to operate mechanism 258.

Figure 14:
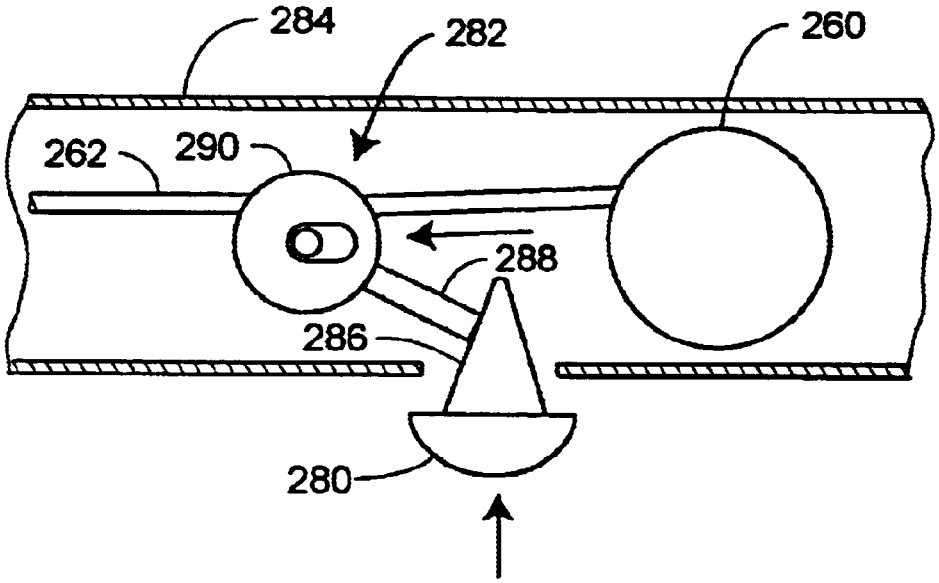
FIG. 14 is a schematic view of a one-way tensioning device according to an alternative embodiment.
Figure 15:
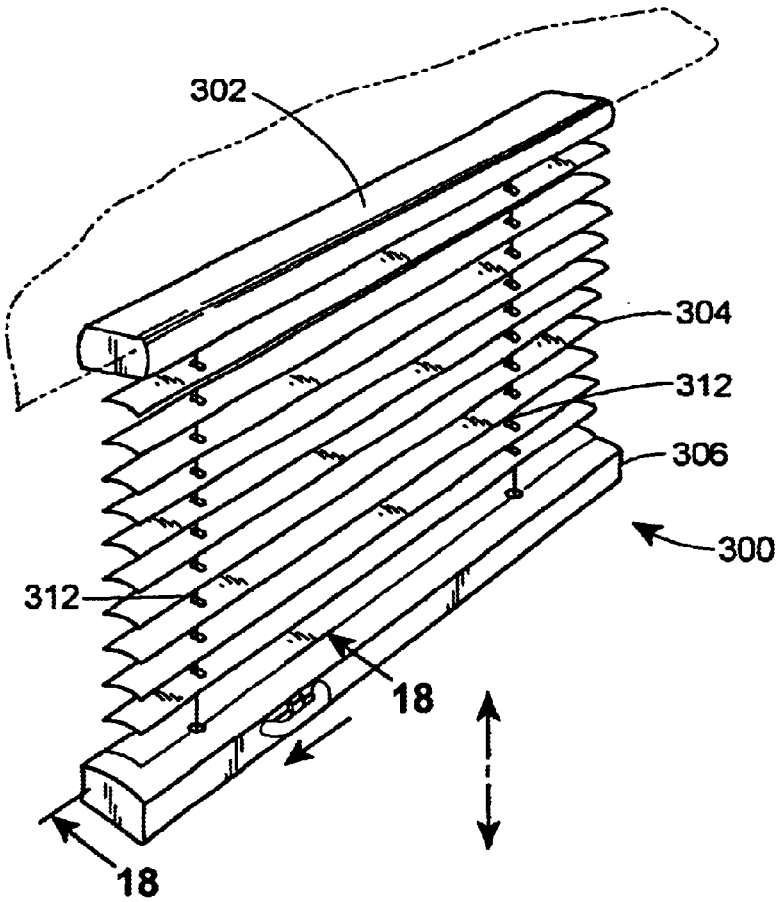
FIG. 15 is a perspective view of a blind with a brake assembly according to a preferred embodiment.
Figure 18:
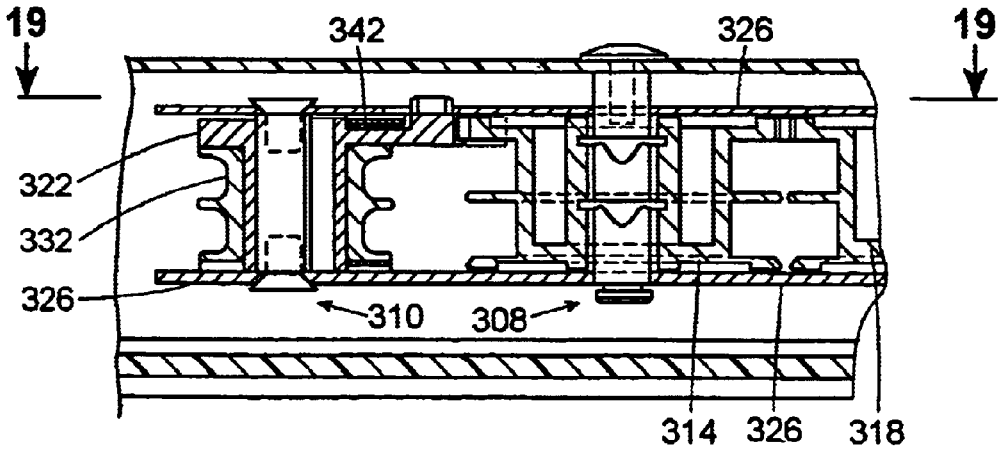
FIG. 18 is a fragmentary section view of the bottom rail of FIG. 15 taken along the line 18—18.
Figure 16:
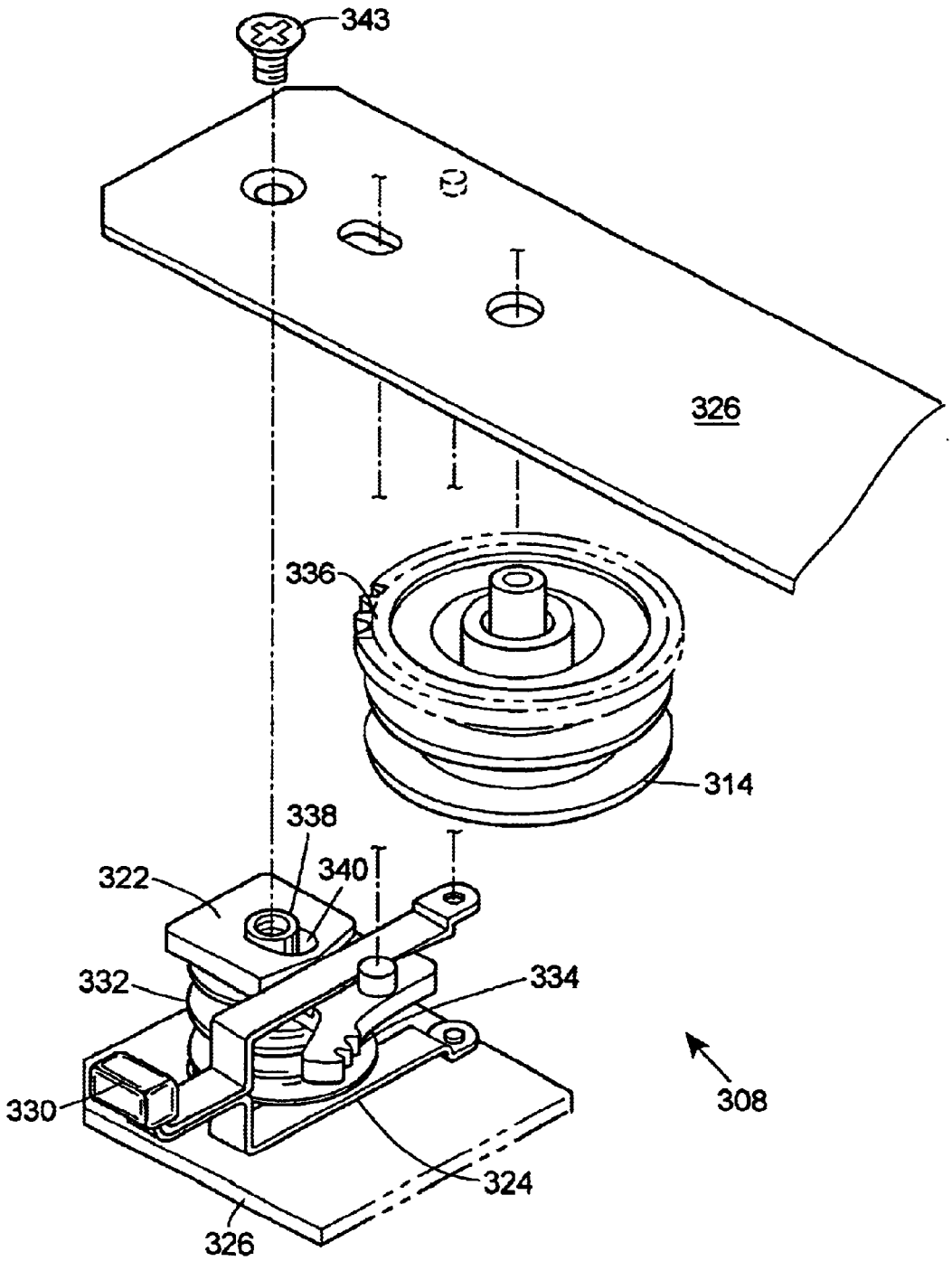
FIGS. 16 and 17 are fragmentary exploded views of the brake assembly for FIG. 15.
Figure 17:
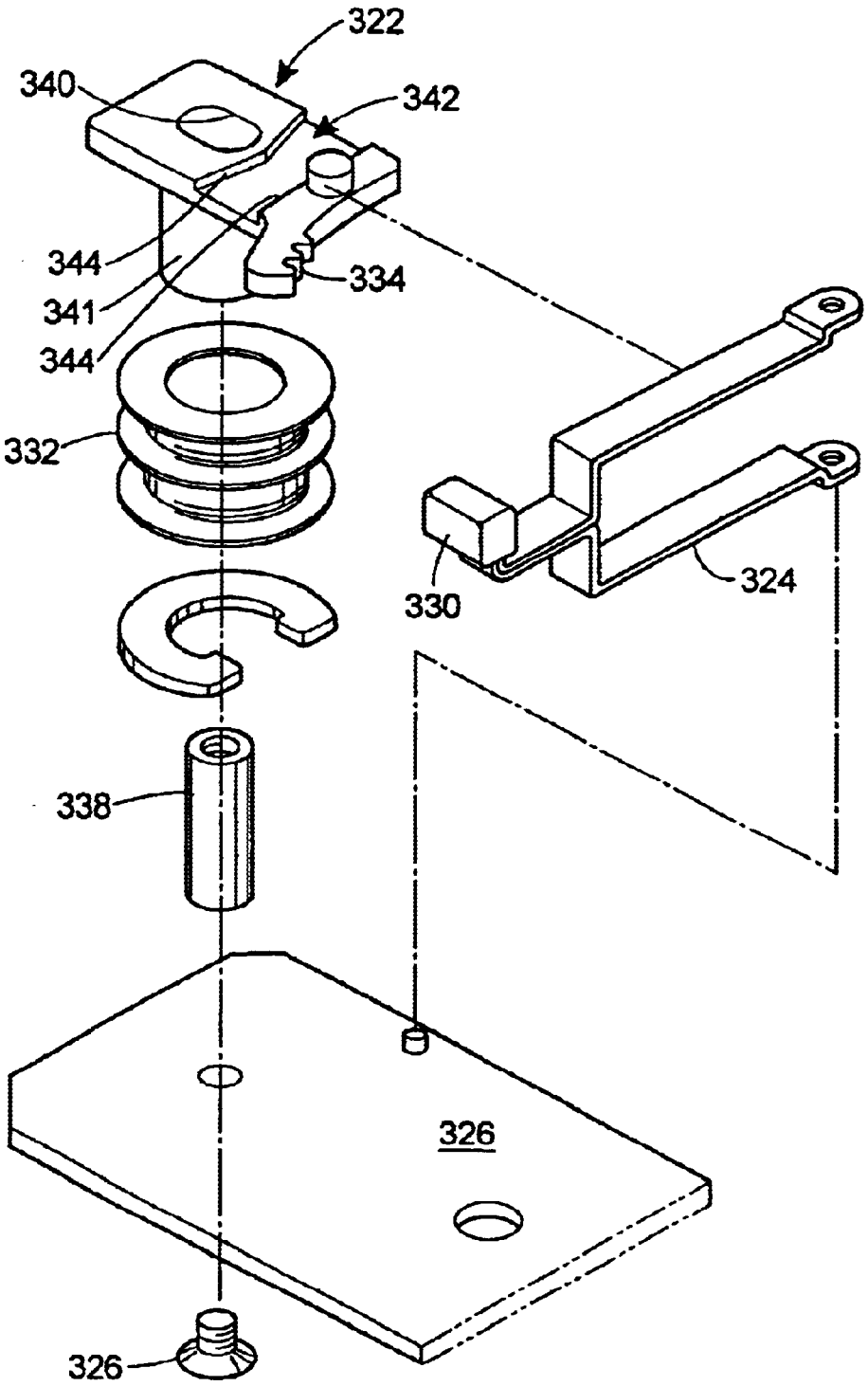
Figure 19:
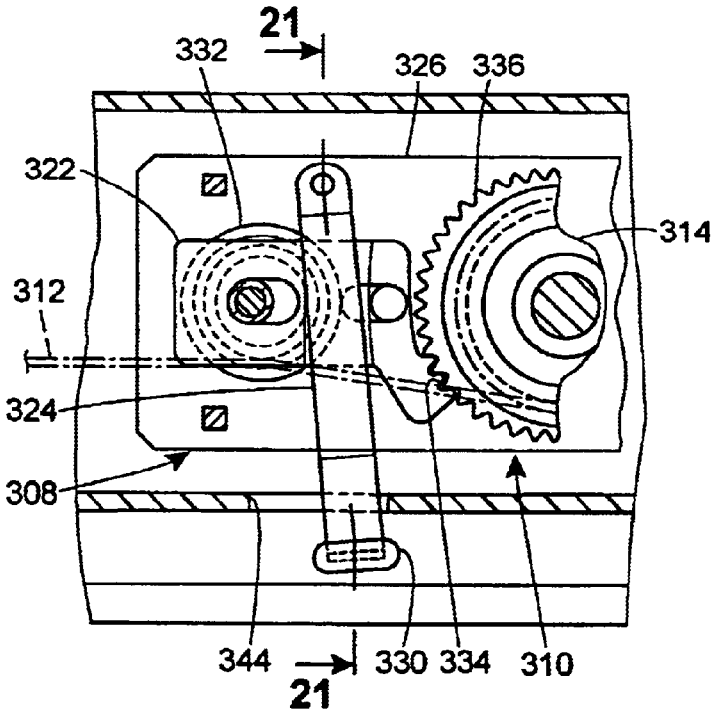
FIG. 19 is a fragmentary top plan view of the brake assembly in an engaged position.
Figure 20:
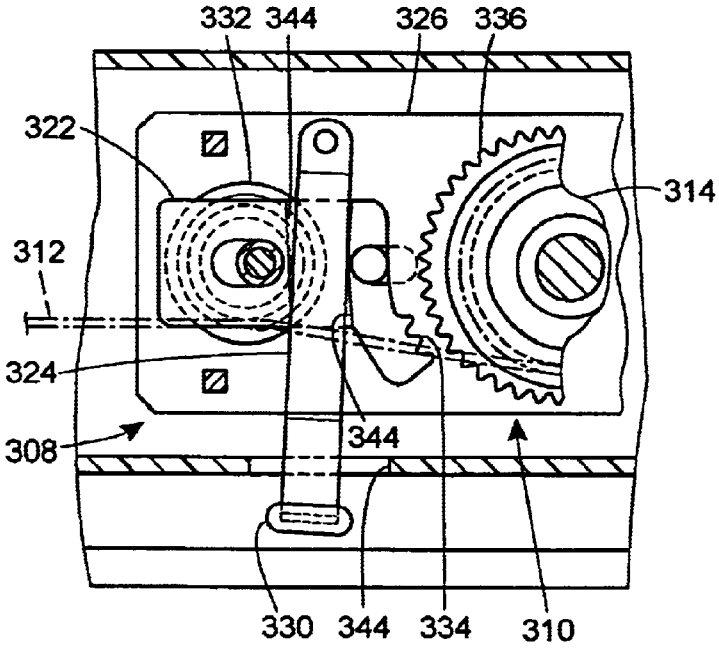
FIG. 20 is a fragmentary top plan view of the brake assembly in a disengaged position.
Figure 21:
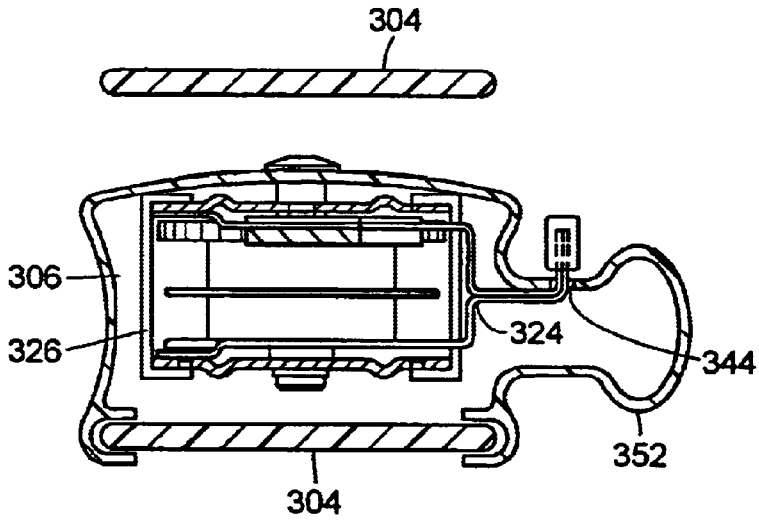
FIG. 21 is a side section view of FIG. 15 taken along the line 21—21.

According to an alternative embodiment shown in FIG. 14, a user interface (shown as a button 280) is operatively coupled to a one-way tensioning mechanism 282, which is mounted in a bottom rail 284. As button 280 is depressed (moved inward toward bottom rail 284), a ramped surface or cam 286 slidably engages a pulley linkage member 288, thereby causing pulley 290 to move to the disengaged position (where the ratchet disengages the pawl).

According to a preferred embodiment shown in FIGS. 15–21, a blind 300 includes a head rail 302, a plurality of slates 304, and a bottom rail 306 having a lift assembly 308 and a brake assembly 310 according to a preferred embodiment.

Lift assembly 308 includes a pair of lift cords 312 (one shown) wound about spools 314 that are coupled to a first spring motor 318 and second spring motor (not shown). First spring motor 318 is coupled to the second spring motor through meshing of gear teeth extending from the perimeter thereof. By coupling the first and second spring motors, brake assembly 310 need only releasably engage one of the spring motors to provide braking action to bottom rail 306. The spring force generated by lift assembly 308 is sufficient to lift bottom rail 306 (and any accumulated slats) towards the head rail absent the positive engagement of brake assembly 310.

Brake assembly 310 is mounted in bottom rail 306 and is configured to releasably engage first spring motor 318. Brake assembly 310 includes a brake 322, a brake lever 324, a user interface 330, and a pulley 332. Pulley 332 is rotatably mounted on brake 322. Lift cords 312 are wound at least once around pulley 332 before winding/unwinding from spool 314 in first spring motor 318. Brake 322, brake lever 324, the spring motors, and spools 314 are mounted to a frame 326 (shown as a set of plates) that is mounted in bottom rail 306.

Brake 322 includes protrusions (shown as teeth 334) that selectively interface with gear teeth 336 around the circumference of spool 314. When teeth 334 are engaged with gear teeth 336, bottom rail 306 is maintained in a static position. Brake 322 is slidably mounted on a shaft 338 that extends through an elongated slot 340 in a bearing portion 341 of brake 322. Pulley 332 is rotatably mounted on bearing portion 341 of brake 322. A fastener 343 couples shaft 338 to frame 326. The spring force of first spring motor 318 generates tension in lift cord 312, which biases brake 322 in the locked position (i.e., positively engaged with spool 314).

Disengagement of teeth 334 and gear teeth 336 allows bottom rail 306 to be repositioned. For repositioning bottom rail 306, disengagement of brake assembly 310 may occur by either operating brake assembly 310 or by pulling down on bottom rail 306. Operating brake assembly 310 causes brake 322 to engage or disengage spool 314. Brake 322 is moved between the engaged position and the disengaged position by pivotal movement of brake lever 324. Brake lever 324 is located in a groove 342 in brake 322. Groove 342 is defined by a pair of opposed bearing surfaces 344 that brake lever 324 acts on when being moved by the user. Pivotal movement of brake lever 324 against either of the bearing surfaces 344 causes lateral movement of brake 322.

User interface 330 is mounted on an end of brake lever 324 that extends through an arcuate slot 344 in bottom rail 306. As user interface 330 is slid laterally by the user, brake lever 324 is pivoted. The pivoting brake lever 324 moves brake 322 (and pulley 332) away from first spring motor 318, causing teeth 334 to disengage from gear teeth 336 on spool 314. Bottom rail 306 can then be raised (or lowered) and repositioned. Release of user interface 330 allows tension in lift cords 312 to move brake 322 back into engagement.

Pulling down on bottom rail 306 also causes brake 322 to engage or disengage spool 314. Bottom rail 306 includes a protrusion 348 configured to provide a grip for the user. Protrusion 348 may be any of a variety of extensions capable of being gripped by the user. According to a preferred embodiment, protrusion 348 is an arcuate projection (protuberance, knob, etc.) along the front of bottom rail 306 (e.g., formed by extrusion). By pulling down on bottom rail 306, tension in lift cords 312 moves pulley 332 away from first spring motor 318 and disengages brake 322 from spool 314. Release of bottom rail 306 causes lift cord 312 tension in the opposite direction, which moves pulley 332 towards first spring motor 318 so that brake 322 engages spool 314.

Brake assembly 310 operates as a "one-way brake." Brake assembly 310 positively engages spool 314 of first spring motor 318 to prevent winding up lift cords 312 and raising the bottom rail 306. Brake assembly 310 does not inhibit bottom rail 306 from free falling, rather bottom rail 306 is prevented from free falling by the force generated by first spring motor 318. To raise bottom rail 306, the user slides button 330 (to disengage the brake 322) and repositions bottom rail 306. To lower bottom rail 306, the user grasps bottom rail 306 and pulls downward sufficient to overcome the spring force generated by first spring motor 318. The tension in lift cords 312 moves brake 322 so that it disengages from first spring motor 318 so that spools 314 can unwind lift cords 312.

Figure 22:
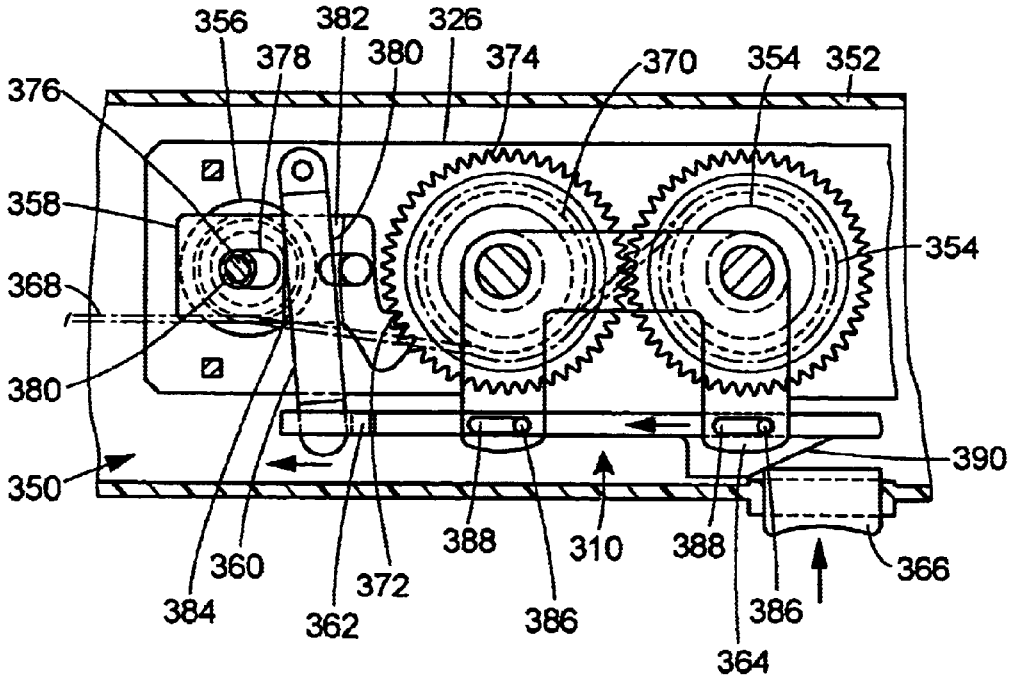
FIG. 22 is a top plan view of a brake assembly according to an alternative embodiment.

Referring to FIG. 22, a brake system 350 for a cordless blind is shown according to an alternative embodiment. Brake system 350 is mounted in a bottom rail 352 of a window covering, and is configured to releasably engage a spring motor 354. The spring force generated by spring motor 354 is sufficient to lift bottom rail 352 (and any accumulated slats) towards the head rail absent the positive engagement of brake system 350.

Brake system 350 includes a pulley 356, a brake 358, a brake lever 360, an arm 362, an arm holder 364, and a user interface (shown as a push)-button 366). Pulley 356 is rotatably mounted on brake 358. One or more lift cords 368 are wound at least once around pulley 356 before winding/unwinding from a spool 370 in spring motor 354.

Brake 358 includes protrusions 372 that selectively interface with gear teeth 374 around the exterior of a component of spring motor 352 (e.g., spool 370). When protrusions 372 are engaged with gear teeth 374 on spool 370, bottom rail 352 is maintained in a static position. Brake 358 and pulley 356 are slidably mounted on a pin 376 that extends through an elongated slot 378 in a shaft 380. Pulley 356 is rotatably mounted on exterior of shaft 380. The spring force of spring motor 354 generates tension in lift cords 368, which biases brake 358 in the locked position (i.e., positively engaged with spring motor 354).

Brake 358 is moved between an engaged position and a disengaged position by pivoting of brake lever 360. Brake lever 360 is located in a groove 382 in brake 358. Groove 382 is defined by a pair of opposed bearing surfaces 384 that brake lever 360 acts on when moving brake 358.

Arm 362 is configured to transfer movement from button 366 to brake 358. Arm 362 is slidably coupled to arm holder 364, which is mounted to spring motor 354. Protrusions 386 extending from arm 362 slidably engage slots 388 in arm holder 364.

Button 366 engages a ramped surface 390 on arm 362, and is configured to initiate movement of arm 362. As button 366 is pressed, it slides along a ramped surface 392, causing arm 362 to move towards the left, thereby pivoting brake lever 360. The pivoting brake lever 360 moves brake 358 (and pulley 356) away from spring motor 354, causing protrusions 372 to disengage from gear teeth 374 on spool 370.

Accordingly, brake system 350 operates as a one-way brake. Brake system 350 positively engages spring motor 354 to prevent spring motor 354 from winding up lift cords 368 and raising bottom rail 352. Brake system 350 is not intended to inhibit bottom rail 352 from free falling, rather bottom rail 352 is prevented from free failing by the force generated by spring motor 354. To raise bottom rail 352, the user presses button 366 (to disengage brake 358) and repositions bottom rail 352. To lower bottom rail 352, the user grasps bottom rail 352 and pulls downward to overcome the spring force generated by spring motor 354. The tension in lift cords 368 moves brake 358 so that it disengages from spring motor 354 so that spool 370 can unwind lift cords 368.

According to an exemplary embodiment (not shown), a blind includes a lift assembly including two or more spring motors. These spring motors each have one or more springs each (depending on the desired spring force-size of the blind). Also, these spring motors may be configured to operate independent from each other (e.g., not operatively coupled to each other). Because the spring motors are configured to operate independently, the blind includes a separate brake assembly associated with each spring motor and a linkage operatively coupling the separate brake assemblies so that a single user interface operates both brakes. Each brake assembly includes a brake and a brake lever. The brake lever is configured to pivot and move the brake between an engaged position and a disengaged position. The linkage includes a user interface (e.g., a button) and a connector that actuates or moves the brake levers (and therefore the brake) between engaged and disengaged positions. The connector may be any of a variety of mechanisms such as a flexible member (e.g., a cord), a rigid member (e.g., an arm made of plastic, metal, etc.), and the like. The connector is coupled to the brake levers so that a single user interface operates both brakes. Alternatively, the connector is coupled directly to the brakes (e.g., without an intermediate brake lever). The user interface, connector, and/or brake lever (or brake) may be configured as a single (e.g., integral or unitary) component, or be configured as multiple components. The user interface can be located at any of a variety positions along the bottom rail. Preferably, the user interface is located in the middle, front portion of the bottom rail. Alternatively, the user interface can be located towards (or at) one of the ends of the bottom rail (e.g., near one of the brake assemblies). According to yet another alternative embodiment, the brake assemblies have separate user interfaces which both are operated by the user when adjusting the position of the blind.

It is also important to note that the construction and arrangement of the elements of the brake for a cordless blind as shown in the preferred and other exemplary embodiments are illustrative only. Although only a few embodiments of the present invention have been described in detail in this disclosure, those skilled in the art who review this disclosure will readily appreciate that many modifications are possible (e.g., variations in sizes, dimensions, structures, shapes and proportions of the various elements, values of parameters, mounting arrangements, materials, colors, orientations, etc.) without materially departing from the novel teachings and advantages of the subject matter recited in the claims. For example, the brake may be configured to engage the lift cords, engage the spring motor, or be configured to provide a variable braking force to the lift cords and/or spring motor. Also, "spring motor" is not used as a term of limitation, but is intended to include any number of biasing mechanisms or elements. Accordingly, all such modifications are intended to be included within the scope of the present invention as defined in the appended claims. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and/or omissions may be made in the design, operating conditions and arrangement of the preferred and other exemplary embodiments without departing from the spirit of the present invention as expressed in the appended claims.

What is claimed is:

1. A window covering comprising:

a head rail;

a bottom rail;

a window covering material extending between the head rail and bottom rail;

a first and second lift cords extending between the head rail and the bottom rail;

a biasing element configured to bias the bottom rail toward the head rail, and operatively coupled to the first and second lift cords;

a one way brake configured to releasably couple to the first lift cord, wherein the biasing element is configured to raise the bottom rail absent engagement of the brake with the first lift cord, and wherein the one way brake prohibits the bottom rail from moving toward the head rail under a biasing force of the biasing element but permits the bottom rail to be moved away from the head rail by the operator.

2. The window covering of claim 1 wherein the biasing element is a pair of spaced apart spring motor assemblies located in the bottom rail.

3. The window covering of claim 1 wherein the brake includes a one-way tensioning mechanism and a user interface, the one-way tensioning mechanism is configured to provide a resistant force on movement of one of the first and second lift cords, and the user interface is configured to move the one-way tensioning mechanism between a stopped condition and a free-wheeling condition.

4. The window covering of claim 3 wherein the one-way tensioning mechanism is biased toward the stopped condition.

5. The window covering of claim 4 wherein the one-way tensioning mechanism is biased toward the stopped condition by tension in the one of the first and second lift cords.

6. The window covering of claim 4 wherein the one-way tensioning mechanism is biased toward the stopped condition by a spring.

7. The window covering of claim 1 wherein the biasing element is located proximate to the brake.

8. The window covering of claim 7 wherein the biasing element is located in the head rail.

9. The window covering of claim 7 wherein the biasing element is located in the bottom rail.

10. A window covering comprising:

a head rail;

a bottom rail;

a window covering material extending between the head rail and bottom rail;

a first and second lift cords extending between the head rail and the bottom rail;

a biasing element configured to bias the bottom rail toward the head rail, and operatively coupled to the first and second lift cords;

a brake including a one-way tensioning mechanism and a user interface, the one-way tensioning mechanism engaging one of the first and second lift cords and being configured to provide a resistant force on movement of the lift cord in one direction, and the user interface being configured to move the one-way tensioning mechanism between a stopped condition and a free-wheeling condition;

wherein the biasing element is configured to raise the bottom rail absent engagement of the brake with the first lift cord.

11. The window covering of claim 10 wherein the one-way tensioning mechanism is biased toward the stopped condition.

12. The window covering of claim 11 wherein the one-way tensioning mechanism is biased toward the stopped condition by tension in the first lift cord.

13. The window covering of claim 11 wherein the one-way tensioning mechanism is biased toward the stopped condition by a spring.

14. The window covering of claim 13 wherein the biasing element is located proximate to the brake.

15. A window covering comprising:

a head rail;

a bottom rail;

a window covering material extending between the head rail and bottom rail;

first and second lift cords extending between the head rail and the bottom rail;

a biasing element configured to bias the bottom rail toward the head rail, and operatively coupled to the first and second lift cords;

a brake assembly configured to inhibit movement of the bottom rail, the brake assembly including:

a brake engaging one of the first and second lift cords and being releasably coupled to the biasing element, wherein tension on the engaged lift cord caused by a biasing force of the biasing element biases the brake toward an engaged position wherein the brake engages the biasing element;

a brake lever pivotally coupled to the bottom rail; and a user interface operatively coupled to the brake lever and configured to pivot the brake between the engaged position and a disengaged position wherein the brake is disengaged from the biasing element.

16. The window covering of claim 15 wherein the user interface is located at least partially external to the bottom rail.

17. The window covering of claim 16 wherein the user interface extends through a slot in the bottom rail.

18. The window covering of claim 15 wherein the user interface includes a brake arm with a cam, and a button operatively coupled to the cam, wherein operation of the button causes the brake arm to pivot the brake lever to the disengaged position.

19. The window covering of claim 18 wherein the cam is a ramped surface on the brake arm.

20. The window covering of claim 15 wherein the brake is configured to laterally move between the engaged and disengaged positions.

21. The window covering of claim 20 wherein the brake includes an elongate shot configured to receive a pin so that the brake slides on the pin.

22. The window covering of claim 15 wherein the biasing element includes a series of gear teeth and the brake includes one or more projections that engage the gear teeth when in the engaged position.

23. The window covering of claim 15 wherein the biasing element includes a spool and the gear teeth extend from the perimeter of the spool.

24. The window covering of claim 23 wherein the brake assembly includes a pulley mounted on the brake, wherein the lift cord is wrapped about the pulley at least once before winding about the spool.

25. The window covering of claim 15 wherein the brake includes a groove defined by a pair of opposed bearing surfaces, wherein the brake arm slides one of the bearing surfaces when pivoting between the first and second positions and the brake between the engaged or disengaged positions.

* * * * *

UNITED STATES PATENT AND TRADEMARK OFFICE

CERTIFICATE OF CORRECTION

PATENT NO. : 6,675,861 B2
DATED : January 13, 2004
INVENTOR(S) : Roger C. Palmer et al.

It is certified that error appears in the above-identified patent and that said Letters Patent is hereby corrected as shown below:

Title page,
Item [75], Inventor, please delete "Zazu Ciuca, Greensboro, NC (US)" and insert -- Zazu Ciuca, Jamestown, NC (US) --.

Column 14,
Lines 42-45, please delete "slides one of the bearing surfaces when pivoting between the first and second positions and the brake" and insert -- slides against one of the bearing surfaces when pivoting between the first and second positions and moving the brake --.

Signed and Sealed this

Thirty-first Day of August, 2004

JON W. DUDAS
*Director of the United States Patent and Trademark Office*